United States Patent [19]

Harmon et al.

[11] 4,208,645

[45] Jun. 17, 1980

[54] FUSE EMPLOYING ORIENTED PLASTIC AND A CONDUCTIVE LAYER

[75] Inventors: Thomas F. Harmon, Chagrin Falls; John C. Sobieski, Richmond Heights, both of Ohio

[73] Assignee: General Electric Company, Schenectady, N.Y.

[21] Appl. No.: 858,940

[22] Filed: Dec. 9, 1977

[51] Int. Cl.[2] ..... H01H 85/14; H01H 85/02

[52] U.S. Cl. ..... 337/297; 337/414; 337/415

[58] Field of Search ..... 337/414, 401, 402, 403, 337/404, 405, 406, 413, 416, 415, 296, 297, 197, 198, 174

[56] References Cited

U.S. PATENT DOCUMENTS

| | | | |
|---|---|---|---|
| 2,462,934 | 3/1949 | Athey | 337/198 |
| 2,941,059 | 6/1960 | Sims et al. | 337/297 |
| 3,500,276 | 3/1970 | Hingorany et al. | 337/416 |
| 4,017,728 | 4/1977 | Audesse et al. | 240/1.3 |
| 4,080,039 | 3/1978 | Ahroni | 337/198 |

FOREIGN PATENT DOCUMENTS

| | | | |
|---|---|---|---|
| 2109760 | 9/1971 | Fed. Rep. of Germany | 337/297 |

*Primary Examiner*—Harold Broome
*Attorney, Agent, or Firm*—Lawrence R. Kempton

[57] ABSTRACT

A fuse is described in which two fusing modes provide protection at low and high overcurrent conditions. The fuse comprises an oriented plastic substrate with a conductive layer adhered thereto.

6 Claims, 2 Drawing Figures

FUSE EMPLOYING ORIENTED PLASTIC AND A CONDUCTIVE LAYER

This invention relates to fuses and, in particular, to fuses for use in electrical plugs connected to low power electrical devices.

Ever since Edison first put a thin wire in a lamp base to make an enclosed fuse, fuses have utilized the melting of an intentionally weak link to provide overcurrent protection, the link being a low melting point conductor. As known by those of skill in the art, the current rating of a fuse is a nominal rating, the opening of the link actually being dependent on a number of factors, eg. the actual current, time, ambient conditions, and the thermal inertia of the conductive link. The thermal inertia of the link, in turn, depends on the dimensions of the link.

For electrical devices drawing more than three amperes, the dimensions of the protective link are large enough that the fuses are relatively inexpensive to manufacture. For less than about three amperes, the link is physically smaller. Thus, while dimensional tolerances remain the same when expressed as a percent, their actual numerical value becomes quite small, making the fuse more difficult and more expensive to manufacture.

For low power devices, such as decorative string sets, clocks and the like, ie. which draw on the order of one half ampere or less, a problem develops if one wishes to fuse the device itself, viz. the fuse will add considerably to the cost of the device. For maximum safety, it is desirable to provide fuse protection in or near the plug. However, plugs having replaceable fuses are expensive to make, further adding to the cost of the device. If one assumes that an overcurrent condition is a failure of the device, ie. that the device should be replaced, then one may reduce costs somewhat by providing a non-renewable fuse plug. However, most small appliances or electrical devices do not have polarized plugs. Since either side of the line may be "hot", both sides of the plug must be fused. Thus, the problem remains, although doubled, of the cost of the fuse.

In view of the foregoing, it is therefore an object of the present invention to provide a non-renewable fuse plug.

A further object of the present invention is to provide a fuse for low power electrical devices.

Another object of the present invention is to provide an easily manufactured fuse and plug.

A further object of the present invention is to simplify the construction of low current fuses and plugs for such fuses.

The foregoing objects are achieved in the present invention wherein a two conductor printed circuit fuse is series connected with each line or conductor within a plug. The printed circuit comprises conductive layers overlying an oriented plastic sheet. For low overcurrent conditions, eg. 200%, the thermal characteristics of the substrate causes the overlying conductor to be pulled apart, opening the circuit. For high overcurrent conditions, eg. 800%, the conductor melts and a portion thereof appears to evaporate from the substrate.

A more complete understanding of the present invention can be obtained by considering the following detailed description in conjunction with the accompanying drawings, in which.

Figure 1:
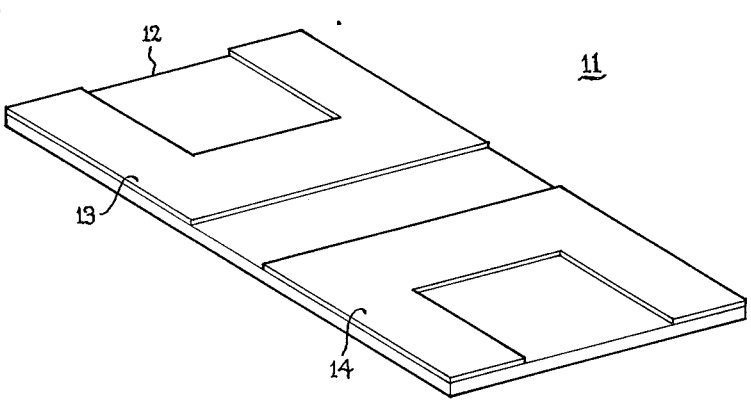
FIG. 1 illustrates a preferred embodiment of a fuse in accordance with the present invention.
Figure 2:
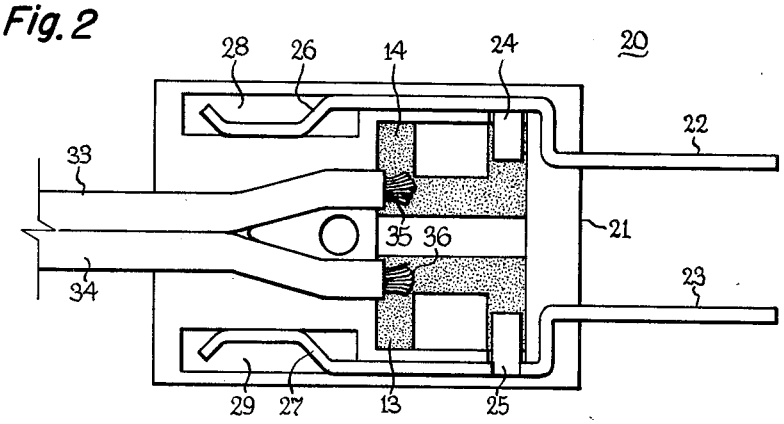
FIG. 2 illustrates a preferred embodiment of a plug in accordance with the present invention.

FIG. 1 illustrates a preferred embodiment of a printed circuit fuse in accordance with the present invention for fusing both sides of a line. Specifically, fuse 11 comprises a plastic substrate 12 having conductors 13 and 14 screen printed thereon. While illustrated as comprising U-shaped conductors, the fusable link may comprise any desired configuration having an elongated portion achieving the fusing characteristic. The reason for the particular configuration in FIG. 1 is apparent from the particular use of a fuse in accordance with the present invention as illustrated in FIG. 2.

Plastic substrate 12 may comprise any suitable plastic having the following characteristics. Plastic substrate 12 when in the form of a sheet and held over a flame should have the characteristic that the plastic shrinks away from the heat forming a hole having a charred perimeter. It has been found that oriented plastics perform in this manner. However, it has also been found that in the plastics industry, the term oriented plastic while generally understood is not unequivocal. As used herein, "oriented plastic" is intended to include those plastics having a stress along at least one axis in the final form of the plastic sheet. Thus, for example, so called annealed plastics are unsuitable for use in the present invention. The stress may be along either one or two axes and, if the latter, the plastic is frequently referred to as biaxially oriented plastic. In addition to the flame test referred to above, the suitability of a given sheet of plastic material may be further evaluated, if the plastic is transparent, by means of a polariscope in which polarized light is transmitted through the plastic and observed through a polarizing filter. As known in the art, the stress within the plastic rotates the plane of the polarization producing an image reminiscent of a topographical map.

A third test to determine the suitability of the given plastic is simply to construct fuses therefrom and subject fuses to both low and high overcurrent conditions. For example, utilizing the flame and overcurrent tests, it has been found that polypropylene and polystyrene having a thickness of from five to twenty mils is suitable for use in the present invention. Other materials may have other ranges.

Other materials such as Mylar and polyethersulfane have not been found suitable at the nominal rating of 1½ amperes since the resulting substrate is too thin for the particular use intended. However, it is believed that these materials are suitable at higher current ratings. Stated another way, the particular problem solved by the present invention is that of a low cost, low nominal current fuse. However, higher current fuses can be made in accordance with the teachings of the present invention.

The conductive ink may be applied to substrate 12 by dipping, brushing or silk screening. Silk screening is preferred since a variety of patterns can be readily made using this method. The conductive ink may comprise any suitable ink, such as commercially available from E. I. duPont De Nemours and Company and sold as DuPont 4929 air dried ink. This ink is silk screened onto substrate 12 and has a dry thickness of approximately 0.5 to 2 mils. By varying the thickness of the ink, the transition between the high over-current failure mode and the low overcurrent failure mode is varied. However, if the conductor is too thin, there may be a problem, depending upon the particular use, with inrush current causing the fuse to open circuit in the high over-current failure mode.

The plastic sheet in accordance with the present invention cooperatively interacts with the conductive layer during low overcurrent conditions to open the circuit mechanically by shrinking and breaking the conductor. This gives the fuse a time/temperature characteristic similar to that of what is known in the art as slow blow fuses. Thus, the low overcurrent nominal fuse rating depends upon the thickness of plastic substrate 12. The break in the circuit is in the nature of a hairline crack in the conductive layer, which restricts the voltages to which the fuse can be subjected, eg. 500 volts or less.

In the high overcurrent mode, fuses in accordance with the present invention act as conventionally constructed fuses in that the time/temperature characteristic of the conductor is such that a portion of the conductor evaporates from the substrate, rapidly opening the circuit. This is true for example at an 800% overcurrent.

A fuse plug in accordance with the present invention may be easily constructed utilizing the printed circuit fuse of FIG. 1 nestled within a suitable plug as illustrated in FIG. 2. Specifically, fuse plug 20 comprises a plastic shell which may be conveniently formed in halves in which half 21 is illustrated in FIG. 2. Suitably formed sheet metal blades 22 and 23, which may for example comprise brass, are positioned within shell 21 with tabs 24 and 25 overlying and in contact with conductors 14 and 13 respectively of fuse 11. As desired, the inner portion of blades 22 and 23 may comprise suitable bends 26 and 27 to hold the blades in place during assembly in chambers 28 and 29 respectively. The circuit through plug 20 is completed by way of leads 33 and 34 having the conductors 35 and 36 overlying the conductors 14 and 13 of fuse 11. The other half of the shell is then laid over half 21 and the plug suitably fastened together, eg. by any suitable adhesive or by ultrasonic or thermal bonding, forming a pressure contact between the conductors 35 and 36 and the conductors of fuse 11. Instead of stripping the ends of leads 33 and 34 as illustrated in FIG. 2, a small, conductive tab or tack may be used to penetrate the insulation of each lead and make contact with the respective conductor of fuse 11.

As is apparent from FIG. 2, blades 22 and 23 of plug 20 are inserted in a suitable socket or outlet. Any subsequent overcurrent condition in the device to be protected or any short circuit to ground of either of leads 33 or 34 will cause the corresponding conductor to open circuit thereby protecting the user.

Having thus described the present invention it will be apparent to those of skill in the art that various modifications can be made within the spirit and scope of the present invention. For example, as previously noted, the conductor may be applied in any desired pattern and may comprise any number of fuse elements on a single substrate. If desired to use the fuse of the present invention as a discrete element, ie. not enclosed within a fused plug, the fuse may be suitably enclosed for example by attaching conductive blades and encapsulating the fuse in a manner described in copending application Ser. No. 859,057 filed concurrently herewith and assigned to the assignee of the present invention. In general, this involves enclosing the fuse in a plastic shell and bonding the blades to the ends of the conductor while simultaneously ultrasonically sealing the enclosure.

What we claim as new and desire to secure by United States Letters Patent is:

1. A fuse comprising:

an oriented plastic substrate having a thickness proportional to the nominal current rating of the fuse;

a conductive layer cooperatively adhering to said substrate and having a thickness of from 0.5 to 2 mils;

wherein said fuse is characterized by a mechanical opening of said conductive layer at low overcurrent conditions and by a melting open of said conductive layer at high overcurrent conditions.

2. The fuse as set forth in claim 1 and further comprising a plurality of conductive patterns on a single substrate.

3. The fuse as set forth in claim 1 wherein said oriented plastic substrate is selected from the group consisting of polypropylene and polystyrene.

4. The fuse as set forth in claim 1 and further comprising means for encapsulating said substrate.

5. The fuse as set forth in claim 4 wherein said encapsulating means comprises an electrical plug having at least one conductor electrically connected to said conductive layer.

6. The fuse as set forth in claim 5 wherein said plug permanently encapsulates said substrate.

* * * * *